US006256798B1

(12) United States Patent
Egolf et al.

(10) Patent No.: US 6,256,798 B1
(45) Date of Patent: Jul. 10, 2001

(54) HELMET WITH ADJUSTABLE SAFETY STRAP

(75) Inventors: Heinz Egolf, Alpenblickstrasse 73, CH-8340 Hinwil (CH); Werner Tress, Singen (DE); Dieter Widmer, Bulach (CH)

(73) Assignee: Heinz Egolf, Hinwil (CH)

( * ) Notice: Subject to any disclaimer, the term of this patent is extended or adjusted under 35 U.S.C. 154(b) by 0 days.

(21) Appl. No.: 09/424,005

(22) PCT Filed: May 14, 1999

(86) PCT No.: PCT/CH98/00198

§ 371 Date: Nov. 15, 1999

§ 102(e) Date: Nov. 15, 1999

(87) PCT Pub. No.: WO98/51176

PCT Pub. Date: Nov. 19, 1998

(30) Foreign Application Priority Data

| | | |
|---|---|---|
| May 14, 1997 | (CH) | 1128/97 |
| Jul. 21, 1997 | (CH) | 1773/97 |
| Sep. 29, 1997 | (CH) | 2274/97 |

(51) Int. Cl.[7] ..... A42B 7/00
(52) U.S. Cl. ..... 2/421; 2/417
(58) Field of Search ..... 2/421, 410, 417, 2/418

(56) References Cited

U.S. PATENT DOCUMENTS

| | | | | |
|---|---|---|---|---|
| 631,880 | * | 8/1899 | Ross | 2/418 |
| 2,739,310 | * | 3/1956 | Frieder et al. | 2/418 |
| 3,018,483 | | 1/1962 | Austin | 2/3 |
| 3,214,809 | * | 11/1965 | Edwards | 2/418 X |
| 3,787,894 | * | 1/1974 | Goodman, Jr. | 2/418 |
| 4,279,037 | | 7/1981 | Morgan | 2/421 |
| 5,331,687 | * | 7/1994 | Kronenberger | 2/418 X |
| 5,357,654 | * | 10/1994 | Hsing-Chi | 2/418 X |
| 5,983,405 | * | 11/1999 | Casale | 2/421 |

FOREIGN PATENT DOCUMENTS

| | | | | |
|---|---|---|---|---|
| 296 13 682 U | | 12/1996 | (DE) . | |
| 365433 | * | 4/1990 | (EP) | 2/417 |
| 0412290 | | 2/1991 | (EP) . | |
| 558427 | * | 9/1993 | (EP) | 2/417 |
| 9501739 | | 1/1995 | (WO) . | |

* cited by examiner

*Primary Examiner*—Rodney Lindsey
(74) *Attorney, Agent, or Firm*—Edwin D. Schindler

(57) ABSTRACT

A helmet with an adjustable safety strap. The length of the strap used for securing the helmet can be adjusted by the wearer continuously, or progressively in stages of 1.5 mm, and fixed or released in any of the positions with only one hand, by way of a turn-lock fastener. The turn-lock fastener is rigidly incorporated in the helmet material and has cords which are guided from its two opposite sides along an inner side of the helmet to deflecting rollers, or deflecting points, on the helmet material, and then further guided therefrom along the strap to be tightened. The safety strap can be worn around the nape of the neck, or include a chin piece, among other manners of construction.

17 Claims, 12 Drawing Sheets

HELMET WITH ADJUSTABLE SAFETY STRAP

BACKGROUND OF THE INVENTION

Figure 1:
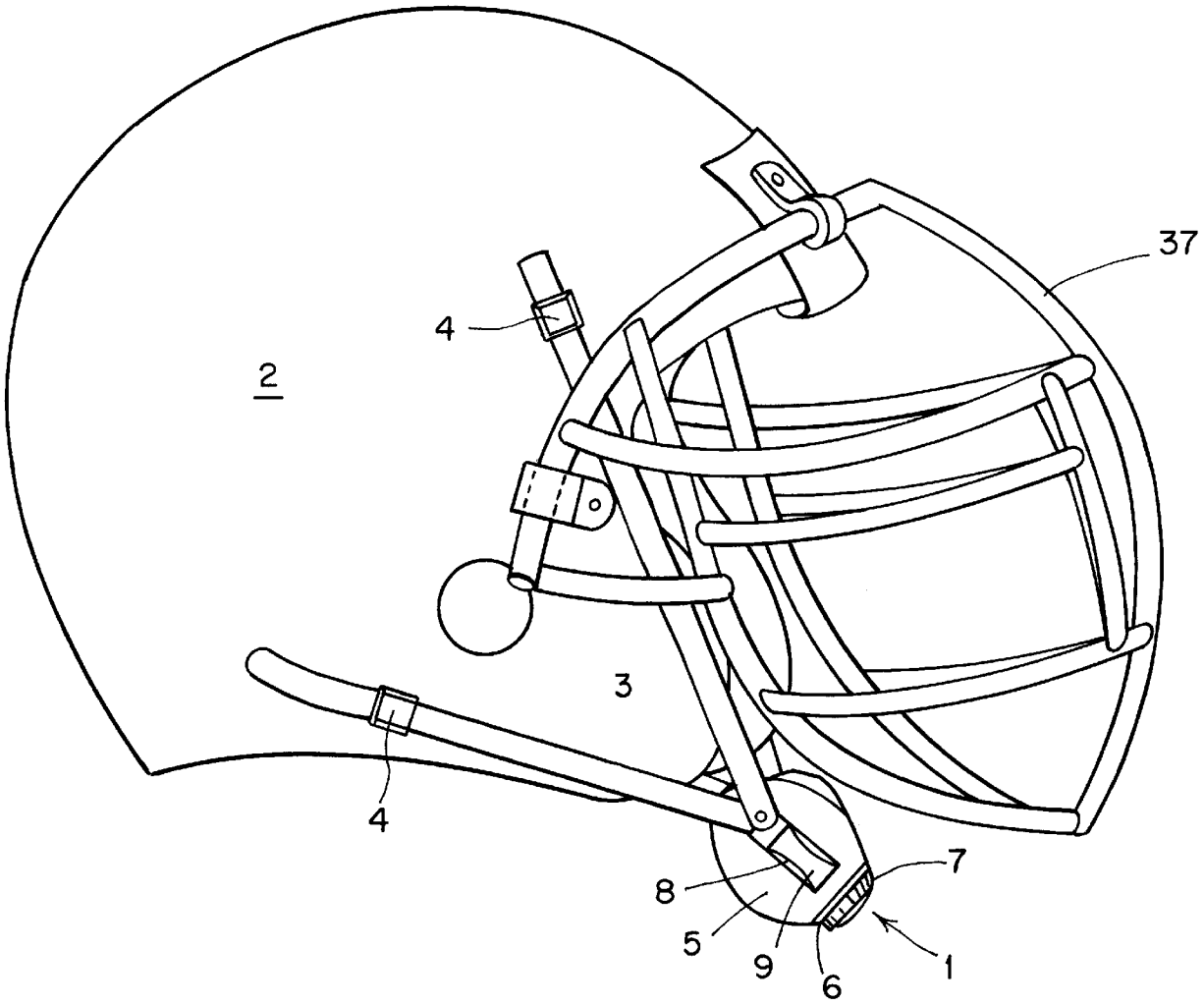

This invention basically relates to a helmet and associated strap. Helmets are used for a wide variety of purposes. Special helmets are worn e.g. by construction workers, miners, firemen and rescue services as a protection against falling objects. Soldiers have always worn helmets in military exercises and battles. There are also many types of special helmets for sports use, e.g. for ice hockey players, for American Football players, for baseball players, for skiers, drivers of bobsleighs and sledges, cyclists and horse riders etc. etc.. The use of helmets by motorcyclists on public roads is also very common, and indeed required by law in many countries. This invention relates to helmets in general, for any helmet has to be secured when worn so that it will remain in place even if the wearer makes abrupt head movements, and so that it does actually fulfil its protective function in the event of any serious incident. As a general rule, the helmet is held in place by means of a two-part strap that is attached to the helmet, the length of which can be adjusted progressively or continuously, and which is joined together when worn e.g. by a hook or a snap-lock. Sometimes the end of a strap is passed through two eyelets on the opposite side of the helmet and then pulled back between these two eyelets so that the strap is secured by means of friction. Other straps are secured by Velcro fasteners or press-buttons.

In many cases, conventional straps are uncomfortable to use, or the length of the strap cannot be adjusted quickly and easily. The adjusting operation is impossible, or very difficult, to accomplish with one hand, even though this would be highly desirable, especially on helmets for cyclists, climbers, horse riders and similar. Very often, the length of the strap cannot be continuously adjusted.

On American Football helmets, for example, there are two straps on either side of the helmet which converge at an angle on a chin protection element forming a trough-shaped moulded piece which cups the chin, to which the four straps are attached. To put on a helmet of this type, the wearer has to adjust the length of all four straps, for which purpose buckles with press-button parts are provided. Once the wearer has adjusted the length of the four straps, someone else often has to help by pressing the buckles of the four straps onto the press-button parts on the helmet to produce the press-button connection. The straps are virtually impossible to adjust whilst the helmet is being worn, and certainly not by the wearer of the helmet himself.

SUMMARY OF THE INVENTION

Hence it is the task of this invention to provide a helmet with an adjustable strap which overcomes the problems described above. The wearer should be able to put the helmet on quickly, and use a finely adjustable tightening force to tighten the strap or straps quickly and comfortably himself, with just one hand. This helmet should also enable the wearer to tighten or loosen the strap easily and quickly, with just one hand, at any time when the helmet is being worn. Equally, the wearer should be able to loosen the strap quickly and easily so that the helmet can be taken off.

This task is solved by a helmet with an adjustable strap which is characterized in that it has at least one strap, the length of which can be adjusted continuously, or in steps of 1.5 mm at the most, and fixed or released in any of the positions by means of a turn-lock fastener which can be operated with one hand.

BRIEF DESCRIPTION OF THE DRAWING FIGURES

Figure 2:
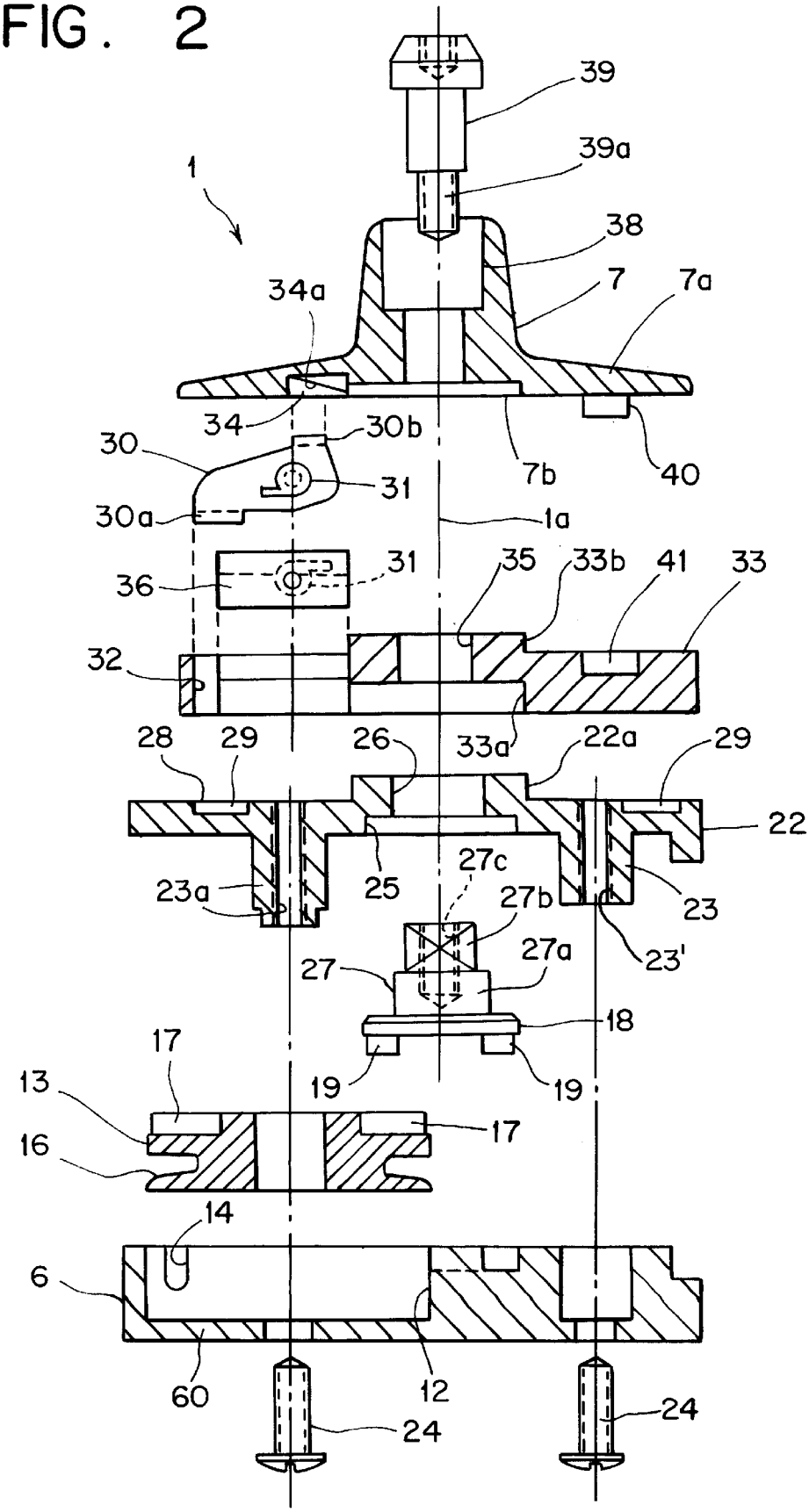
Figure 3:
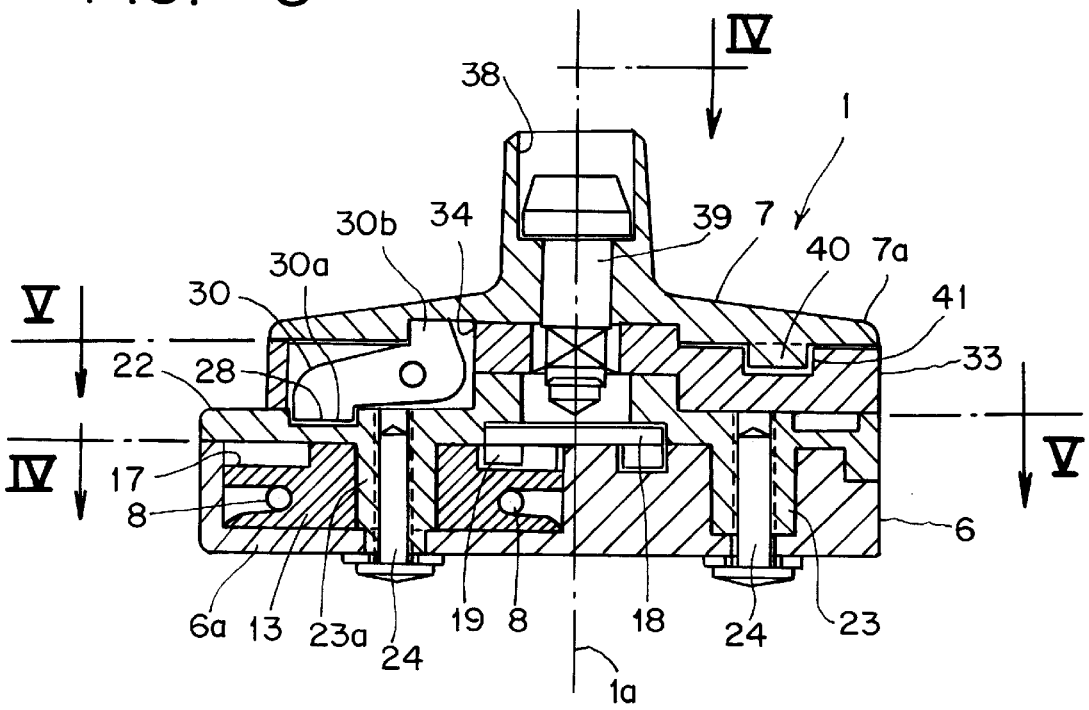
Figure 4:
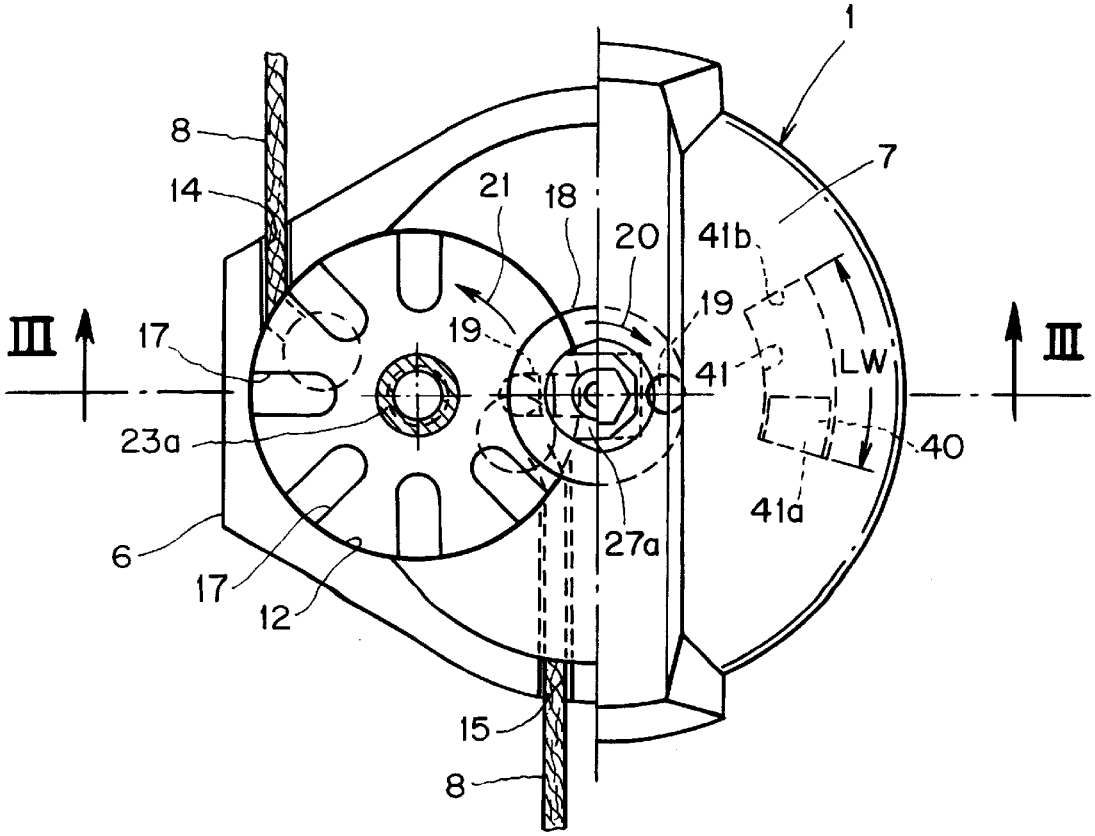
Figure 5:
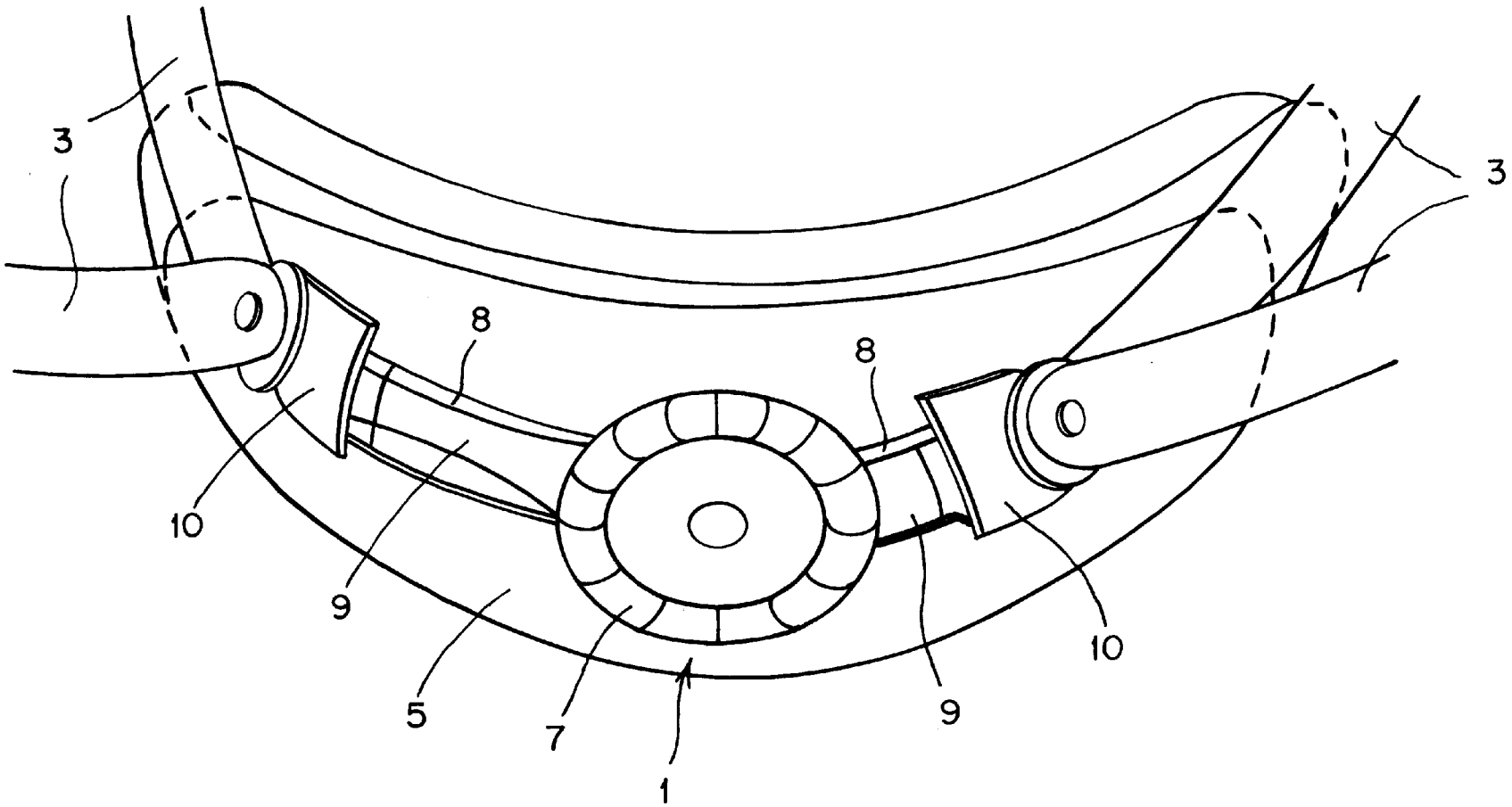
Figure 6:
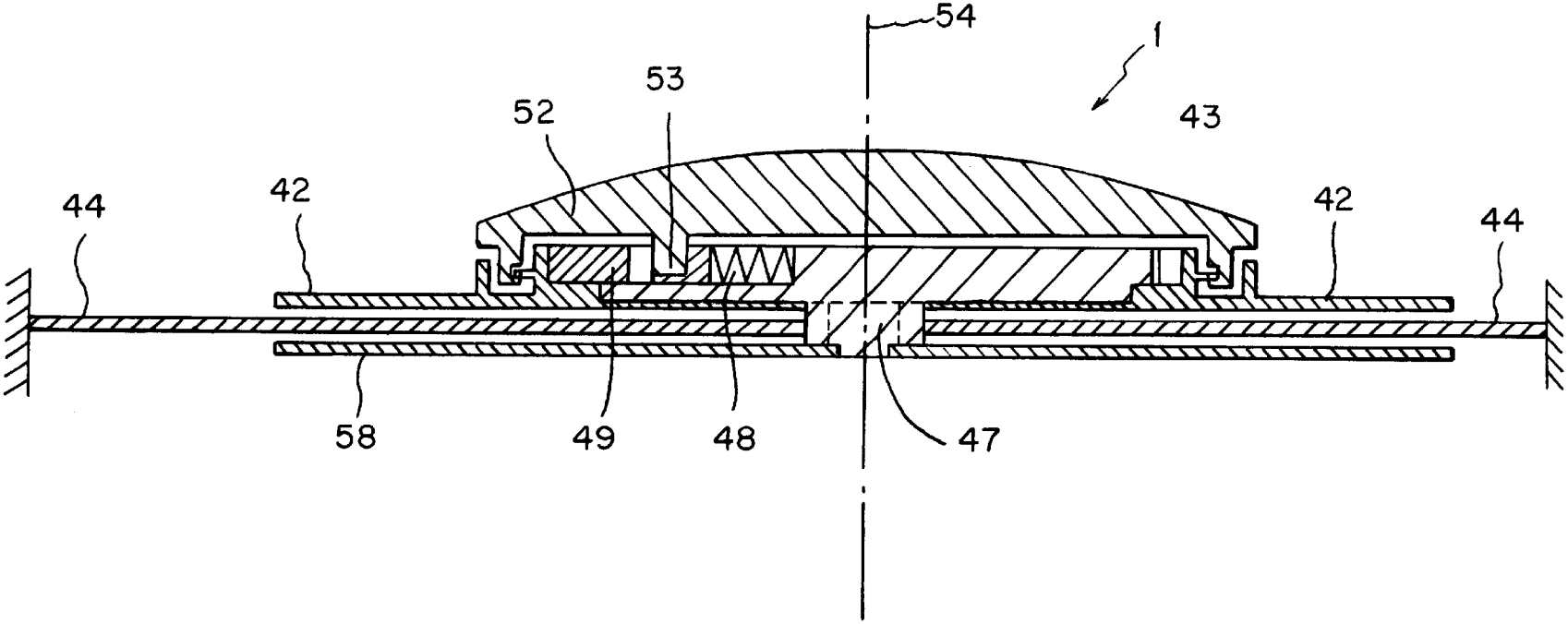
Figure 7:
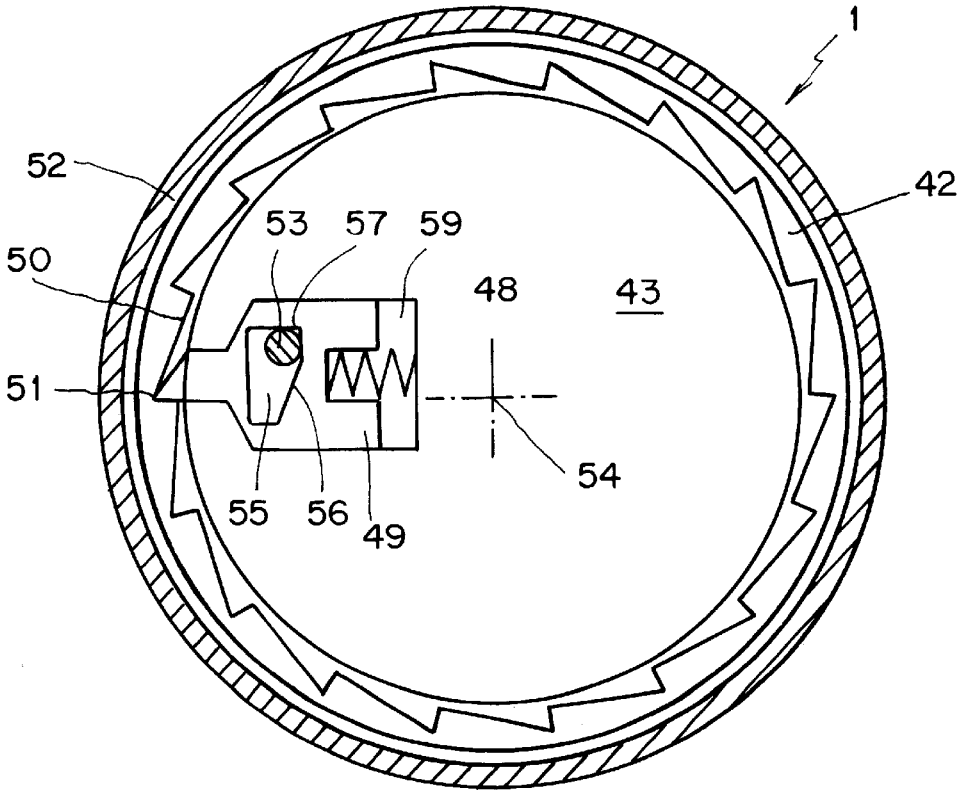
Figure 8:
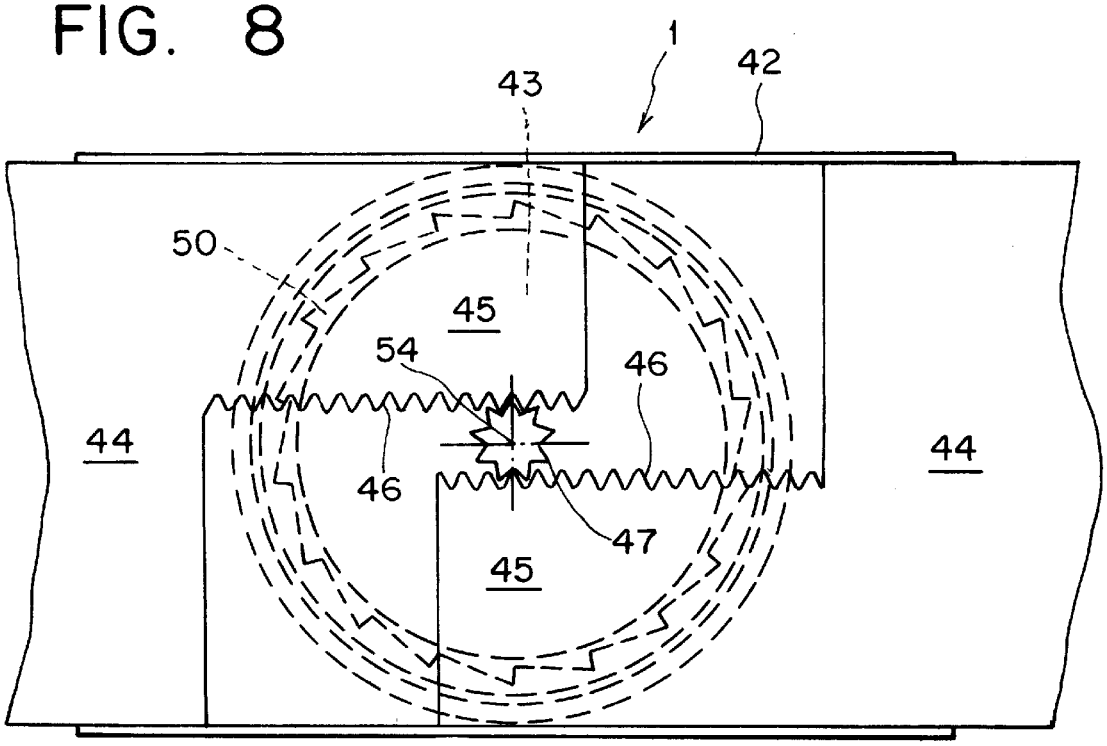
Figure 9:
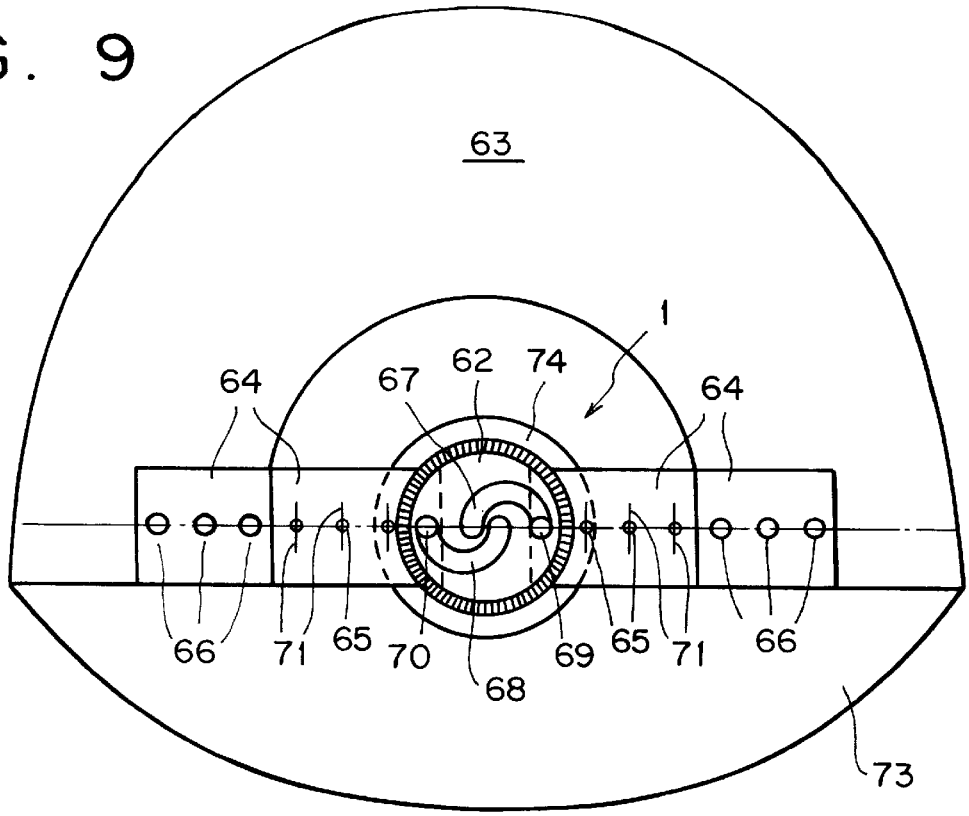
Figure 11:
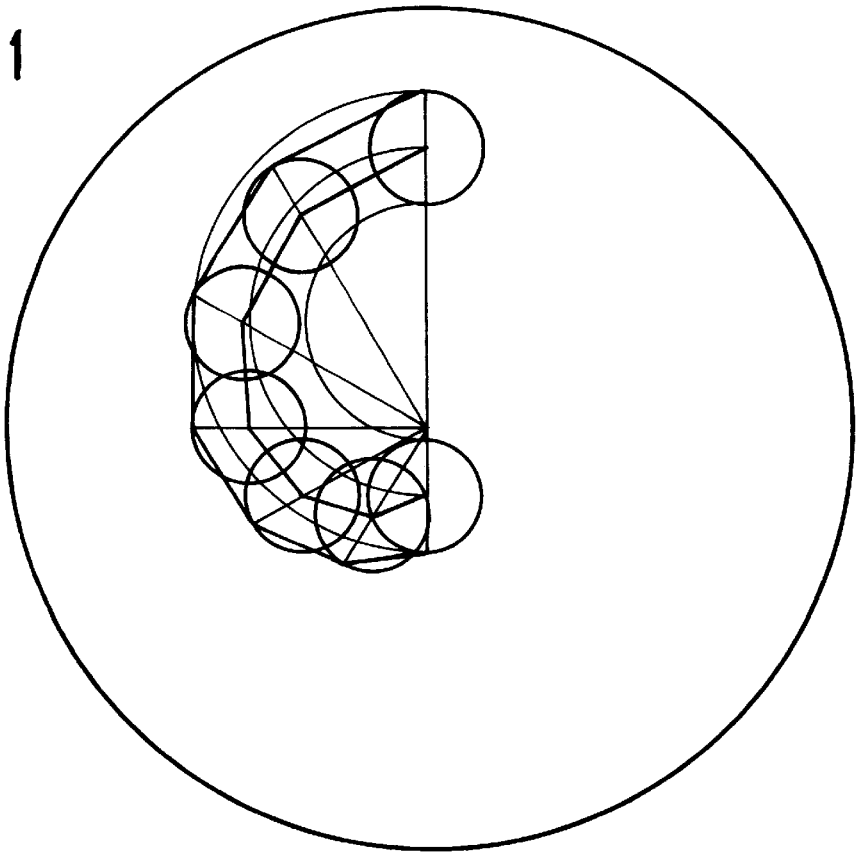
Figure 10:
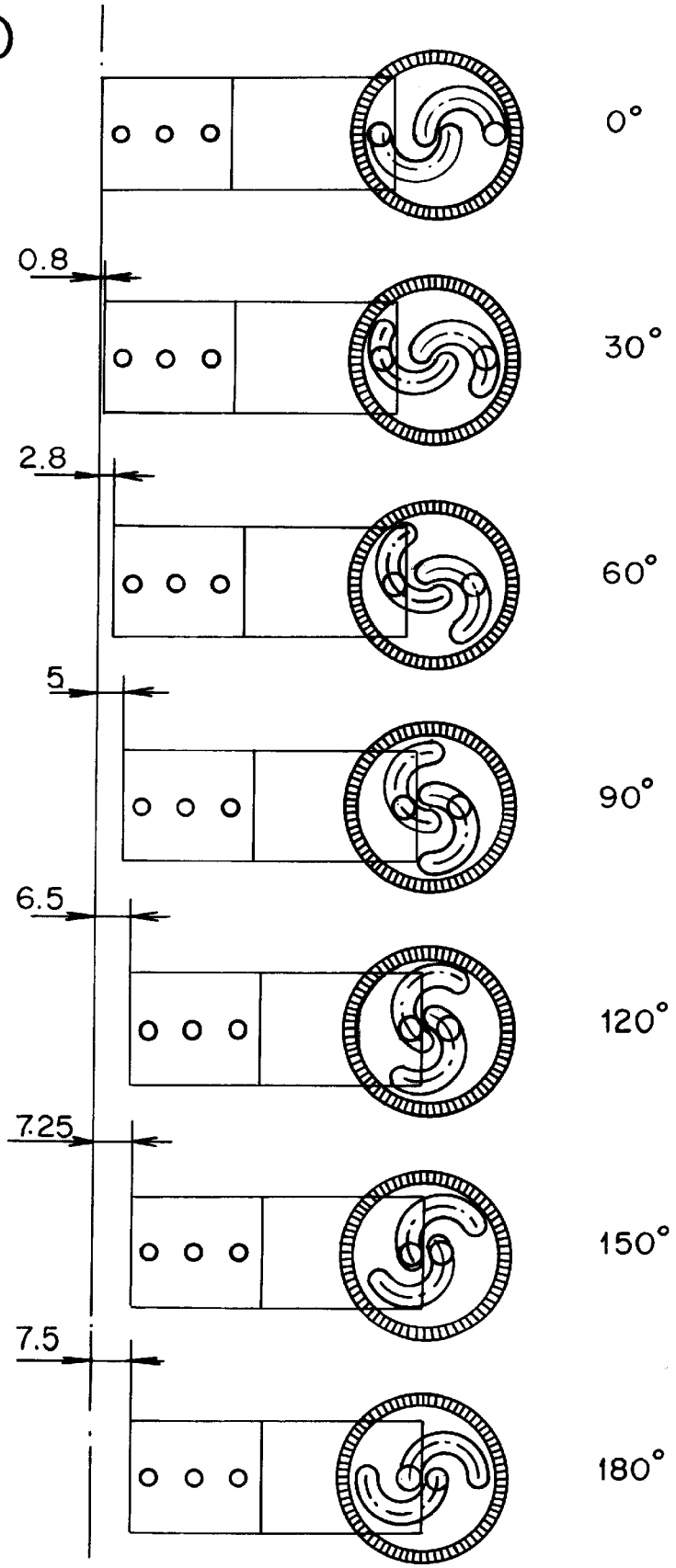
Figure 12:
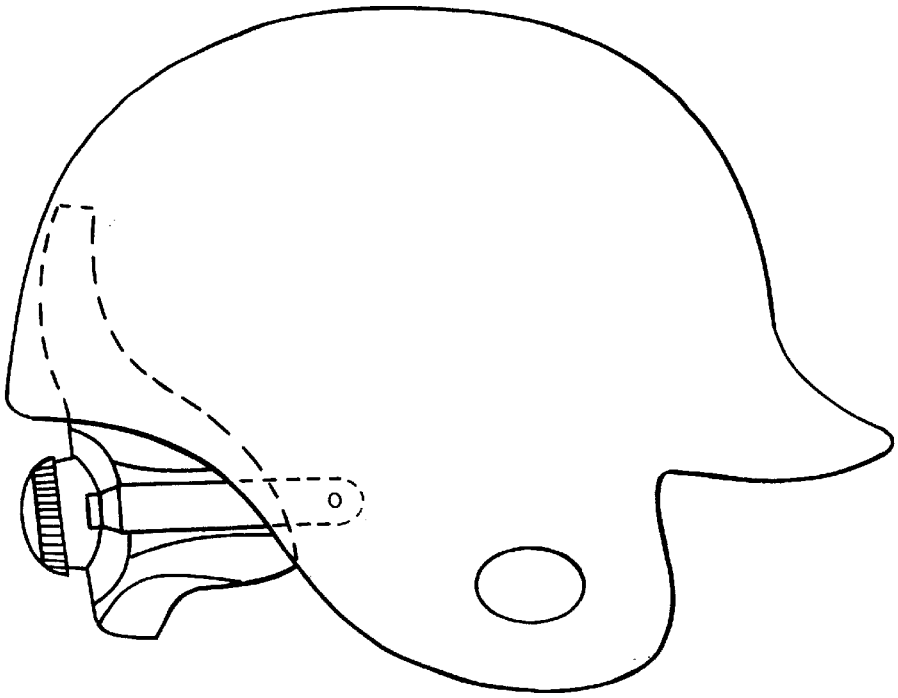
Figure 13:
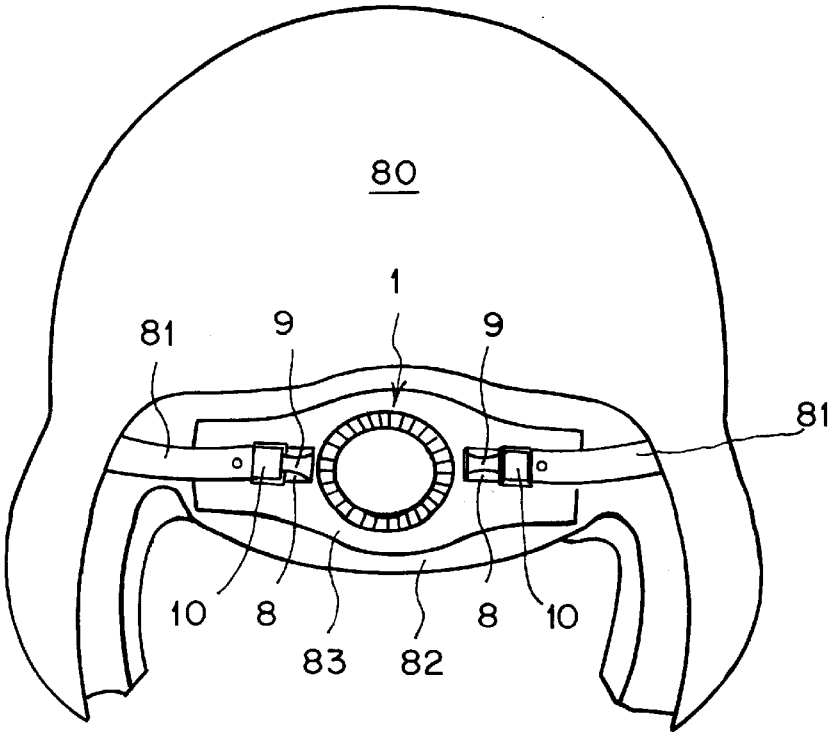
Figure 14:
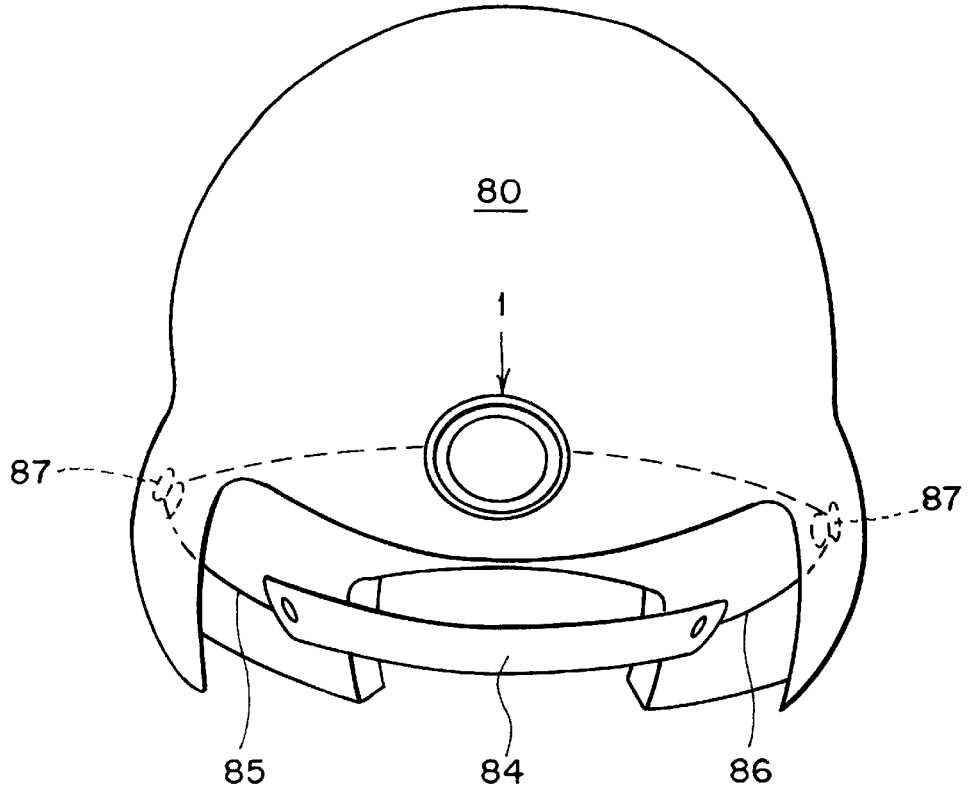
Figure 17:
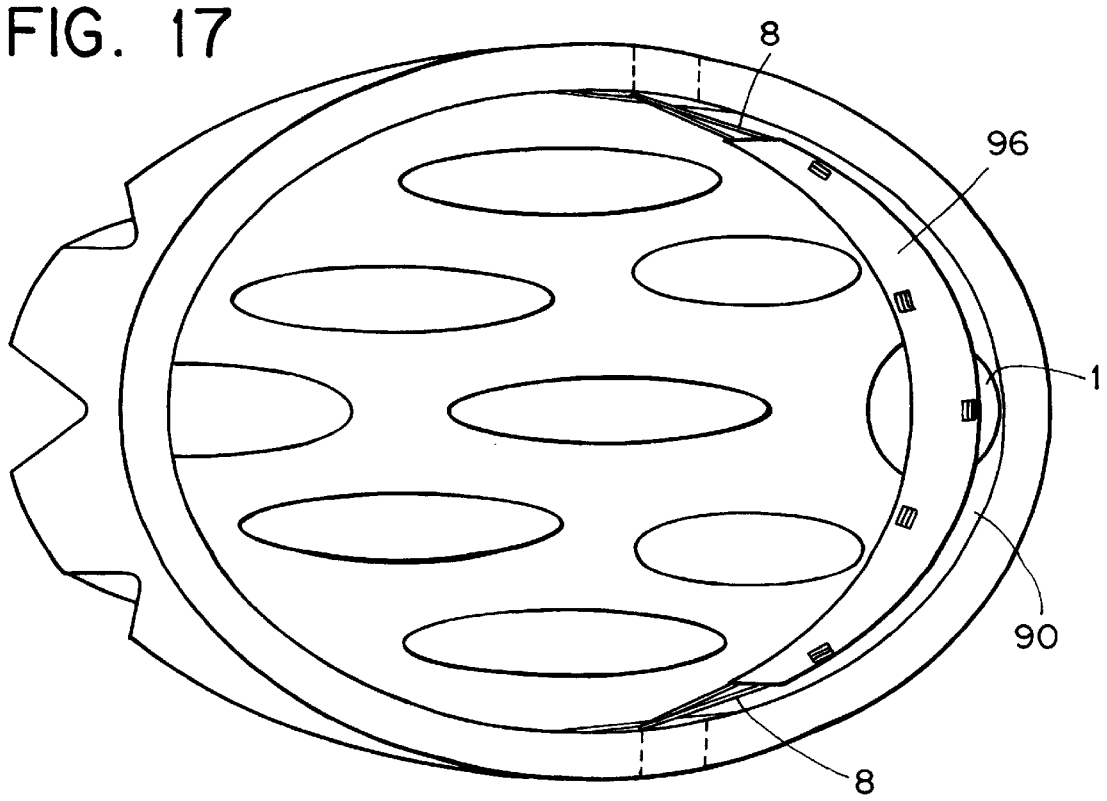
Figure 15:
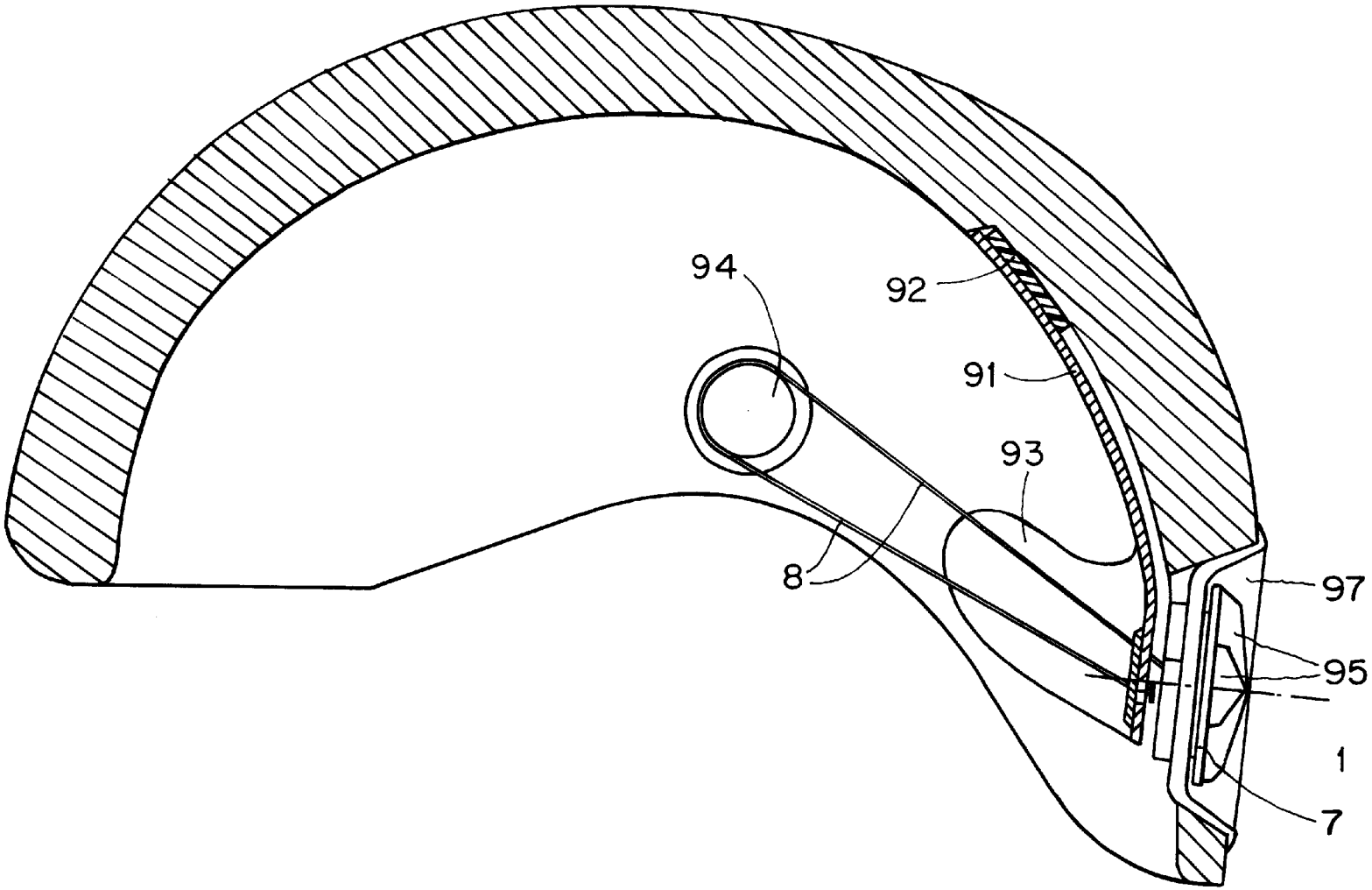
Figure 16:
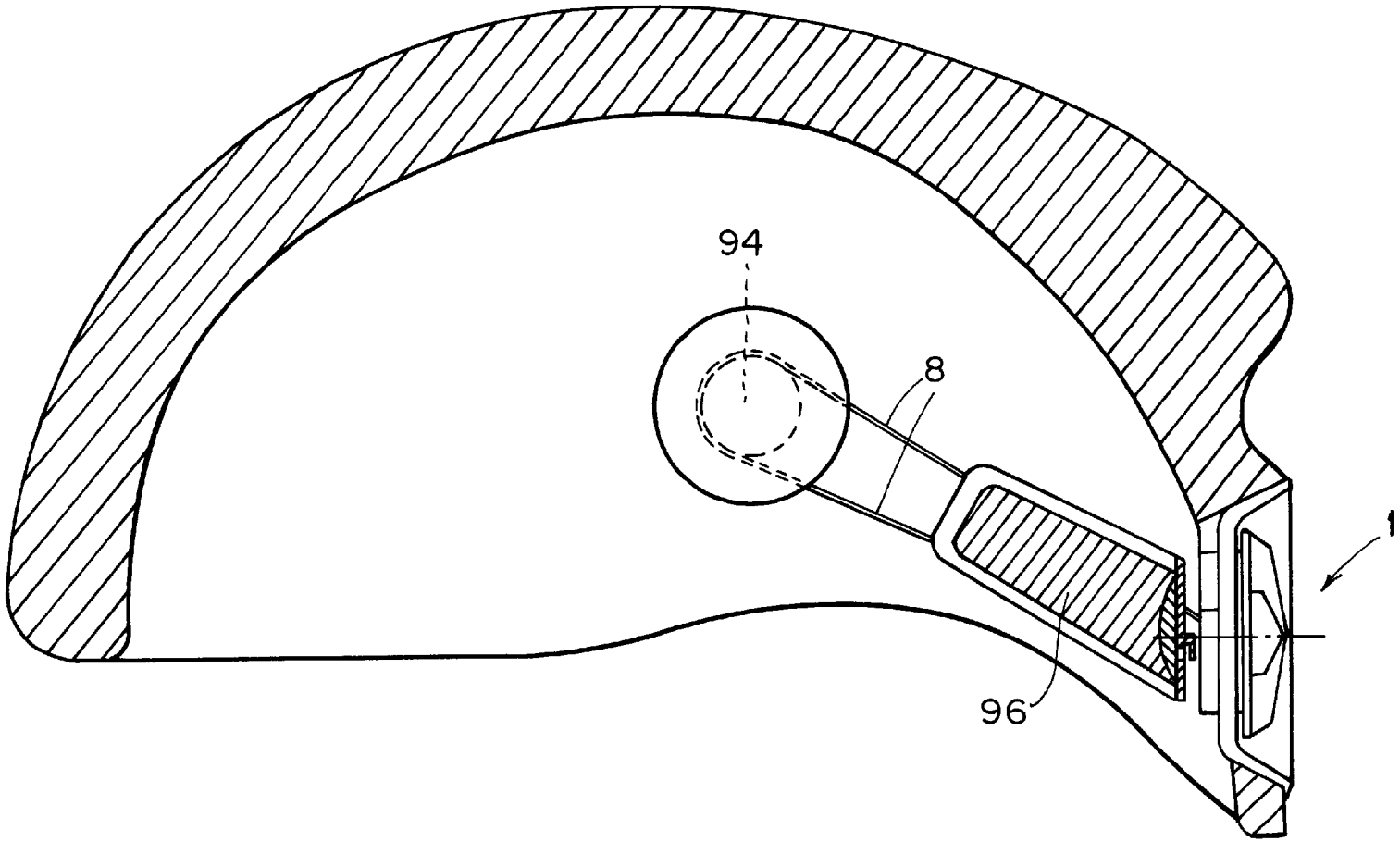

Various embodiments of such a helmet with an adjustable strap will be presented, and their handling and special features explained, in the following description and with reference to the drawings in which:

FIG. 1: is a side view of an American Football helmet with a strap that can be adjusted by means of a turn-lock fastener;

FIG. 2: a turn-lock fastener with a Geneva mechanism for the strap in an exploded drawing with reference to vertical sections;

FIG. 3: the assembled turn-lock fastener with Geneva mechanism in a vertical section;

FIG. 4: the turn-lock fastener with Geneva mechanism seen from above in a partial section;

FIG. 5: the moulded chin protection part with the turn-lock fastener for the strap of the American Football helmet, seen on its own from the front;

FIG. 6: a turn-lock fastener with rack-and-pinion drive, seen in a cross-section from the side;

FIG. 7: the turn-lock fastener with rack-and-pinion drive of FIG. 6, seen from above, without gripping wheel;

FIG. 8: the turn-lock fastener with rack-and-pinion drive of FIGS. 6 and 7, seen from underneath, without the bottom cover;

FIG. 9: a turn-lock fastener with curved grooves acting as cam discs on a construction worker's helmet, seen from the rear;

FIG. 10: separate frames of the turn-lock fastener of FIG. 9 depicting stages in the continual tightening operation;

FIG. 11: the shape of the curved groove in a turn-lock fastener designed to generate proportional tightening movement;

FIG. 12: a side view of a baseball helmet with a strap that can be adjusted by means of a turn-lock fastener;

FIG. 13: the baseball helmet of FIG. 12, seen from the rear;

FIG. 14: an alternative baseball helmet in which the turn-lock fastener for the strap is rigidly incorporated in the helmet shell;

FIG. 15: a cyclist's helmet with a neck strap tongue, in which the turn-lock fastener for the strap is rigidly incorporated in the helmet shell, shown in a longitudinal section;

FIG. 16: a cyclist's helmet with a neck strap, in which the turn-lock fastener for the strap is rigidly incorporated in the helmet shell, shown in a longitudinal section;

FIG. 17: the cyclist's helmet with neck strap of FIG. 16 in a view from below into the inside of the helmet.

DETAILED DESCRIPTION OF THE DRAWING AND PREFERRED EMBODIMENTS

FIG. 1 shows a side view of an American Football helmet with straps which can be tightened and released by means of a turn-lock fastener 1 which can be operated with one hand. The helmet comprises a helmet shell 2, which is padded on the inside with a layer of foam which is attached at several points to the inside of the helmet shell by means of Velcro fasteners. Because the foam layer is hard and dimensionally stable, it does not fit snugly around every shape of head. To make the helmet comfortable to wear in spite of this, a basket-shaped insert made from hollow rubber profiles which can adapt to each wearer's head shape is inserted into the helmet from underneath. At the front, a very stable protective grid 37 is rigidly attached to the helmet shell. The only side on which the helmet remains open is at the bottom, so the wearer therefore has to put it on by slipping it over his head and pulling it down. The overall strap comprises four straps 3 which converge from different points on helmet shell 2 on the wearer's chin, where they are attached to a trough-shaped moulded element 5, which cups the wearer's chin. Each helmet wearer has to individually adjust the length of the four straps 3. For this purpose they are fitted at their ends with e.g. a buckle 4 with a press-button, through which the end of the strap is threaded. Buckle 4 can be moved along strap 3 and fixed in any place by tension. The press-button on buckle 4 is then secured to the press-button counterpart which is mounted on helmet shell 2. The moulded element 5 for the chin is made from a plastic shell adapted to the shape of the chin in which a turn-lock fastener 1 with a rotating knob 7 is fitted.

This turn-lock fastener 1 is the core element in realising a helmet strap of this type, i.e. which can be tightened, adjusted and released with just one hand. It basically comprises a flat housing 6, a rotating knob 7 disposed on top of the housing which can be rotated relative to the latter and two pull cords 8, which pass out of the housing on opposite sides and are connected to straps 3. A rotary actuator construction inside the housing of turn-lock fastener 1 allows the helmet strap to be tightened or released by turning rotating knob 7. To achieve this, the rotary actuator construction is used to turn a cord wheel, for example, on which the ends of the cords are wound, in one direction or the other so that, by turning rotating knob 7 as required, the effective length of pull cords 8 can be modified in opposite directions, thereby provoking a loosening and tightening of said straps 3 and therefore of the whole strap overall.

Such turn-lock fasteners 1 may be used in a variety of constructions. One possible construction is described below with reference to the exploded vertical section shown in FIG. 2. Beginning at the bottom, one sees first the flat housing 6 of turn-lock fastener 1, which, in a top plan view, has a circular bore 12, into which fits a cord wheel 13, as shown above, with a circumferential groove 16. Leading into this bore 12 at approximately diametrically opposed points, there are guide channels 14, through which the corresponding ends of pull cords 8 pass out of housing 6 on opposite sides. The top surface of cord wheel 13 forms a Geneva cross with four radial guide grooves 17 disposed around its periphery, which act as drive elements, as will be explained below. Disposed in housing 6 coaxially to the geometrically vertical main axis 1*a* of the overall turn-lock fastener 1, and slightly above cord wheel 13, there is a drive wheel 18 which, as the drive wheel, is fitted with two eccentrically disposed drive pins 19, which are approximately diametrically opposed to each other and project from the underside of drive wheel 18 down towards cord wheel 13. In the assembled turn-lock fastener, these drive pins 19 engage in the radial guide grooves 17 on the Geneva cross, thereby forming a Geneva mechanism which functions so that when drive wheel 18 is rotated, drive pins 19 engage one after each other in the guide grooves 17 disposed consecutively around the periphery of cord wheel 13, which is contrived as a Geneva wheel, thereby driving the cord wheel, whereupon the ends of the cords are wound onto cord wheel 13, tightening the helmet strap as this happens. By turning in the opposite direction, the pulling cords are unwound, and the strap is loosened. Housing 6 with cord wheel 13 and drive wheel 18 is closed off at the top by a cover 22, on the underneath of which there are securing pins 23,23*a* which run parallel to vertical main axis 1*a*, of which one securing pin 23*a* simultaneously forms a pivot pin for guiding and mounting cord wheel 13. Running through these securing pins 23,23*a* there are threaded bores 23' and 23*a*' into which are screwed screws 24 which are introduced through housing base 6*a* so that cover 22 is detachably connected to housing base 6*a* via securing pins 23,23*a*. Coaxial to the vertical main axis 1 a of turn-lock fastener 1, the underneath of cover 22 has a bore 25 for accommodating drive wheel 18, and a cylindrical mounting bore 26 in which the bottom, cylindrical end 27*a* of an upwardly projecting pin 27 on drive wheel 18 is centrically mounted and guided. The top, tapered end 27*b* of this pin 27 projects upwardly through mounting bore 26 and is squared, and there is also a central threaded bore 27*c* in this pin 27. In the top of cover 22 there is an annular gear 28 with a plurality of engaging teeth 29, which is part of a locking pawl device which will be explained in more detail below. This annular gear 28 has engaging teeth 29 distributed around its periphery, which serve for the fine adjustment of turn-lock fastener 1. A locking pawl 30 shown further up also forms part of said locking pawl device; it is contrived like a two-armed lever and is held pivotably, via pivot axis 31, in an adapted through-recess 32 in an intermediary wheel 33, said recess being located in the region above annular gear 28. One of the levers of locking pawl 30 has a bottom projecting tooth 30*a*, with a top projecting tooth 30*b* on its other lever. By means of bottom projecting tooth 30*a*, locking pawl 30 can engage in the teeth 29 of annular gear 28, whilst the upper projecting tooth 30*b* of locking pawl 30 projects into an approximately ring sector shaped control recess 34 contrived in the underside of the rotating knob 7 above it, said control recess having a slopingly inclined control surface 34*a* at one end. The top projecting tooth 30*b* of locking pawl 30 can engage in this, thereby preventing the turn-lock fastener from releasing itself.

The cylindrical central recess 33*a* in the underside of intermediary wheel 33, which is disposed between rotating knob 7 and cover 22, rests on a central, cylindrical mounting projection 22*a* in the top of cover 22 such that the intermediary wheel is freely rotatably mounted and guided. It also has a square through-opening 35 disposed central to the main axis 1*a*, in which the square top end 27*b* of drive wheel 18 engages so that a torsion-resistant connection is created between drive wheel 18 and intermediary wheel 33. The locking pawl 30 is inserted from above into through-recess 32 in intermediary wheel 33 by means of two jewel bearings 36 disposed on either side. Also projecting into these jewel bearings 36 are the ends of pivot axis 31, with a helical spring being disposed on pivot axis 31 in the region between one jewel bearing 36 and locking pawl 30, so that locking pawl 30 is pre-loaded with its bottom projecting tooth 30*a* in the direction of engaging teeth 29 of annular gear 28. Rotating knob 7, which includes a broadened element 7*a* like a cover, covers over the top of intermediary wheel 33, with a central, cylindrical mounting projection 33*b* projecting from the top of intermediary wheel 33 into a central, also cylindrical, recess 7*b* on the underside of rotating knob 7 for the purpose of guiding and mounting it. Coaxial to the vertical main axis 1*a* of turn-lock fastener 1, there is a central, multi-diameter bore 38 inside rotating knob 7, through which a collar screw 39 can be inserted in such a way that its bottom threaded end 39*a* can be threaded into threaded bore 27*c* in drive wheel 18. Collar screw 39 may be a hexagon socket screw that is completely sunk in bore 38.

In FIG. 3, the individual parts of the turn-lock fastener described above are shown assembled in a cross-section.

With this embodiment of turn-lock fastener 1 it is also important to create an idle movement to ensure that rotating knob 7 is mounted and guided relatively free to rotate within limitations on top of intermediary wheel 33. To create this idle movement, there is a downwardly projecting driving pin 40 on the underneath of rotating knob 7, in this instance diametrically opposite control recess 34, which engages in a ring sector-shaped recess 41 in the top of intermediary wheel 33, with said ring sector-shaped recess forming limit ends 41*a*,41*b* with its peripherally-oriented ends, as can best be seen in FIG. 4. When these limit ends 41*a*,41*b* come into contact with driving pin 40 when rotating knob 7 is turned one way or the other, they limit the idle movement of this rotating knob 7. This means that as it moves in either direction, rotating knob 7 is mounted and guided on and opposite intermediary wheel 33 such that it can be rotated relatively freely but limited in line with the length of the idle movement. The length of this idle movement coincides with the circumferential length of control recess 34, with which the top projecting tooth 30*b* of locking pawl 30 engages as a kind of control projection. Hence when rotating knob 7 is rotated in the direction of the tightening movement of turn-lock fastener 1, rotating knob 7 initially moves alone, i.e. free relative to drive wheel 33 until its drive pin 40 comes into contact with the corresponding limit end 4 1*a* in recess 41. As a result, the action of the spring preloading pushes top projecting tooth 30*b* on locking pawl 30 completely into control recess 34, whilst the bottom projecting tooth on the locking pawl is at the same time pressed by the spring to engage with teeth 29 of annular gear 28. Rotated to tighten further, cord wheel 13 is rotated via the Geneva mechanism so that the corresponding ends of the pull cords are wound onto this cord wheel 13, thereby tightening the straps. As this happens, locking pawl 30 engages with the teeth 29 distributed around the periphery of annular gear 28. When the tightening movement effected through rotating knob 7 is complete, the setting of the turn-lock fastener 1 is locked in position by the engaged pawl position. This means the straps on the helmet can be adjusted with great precision, to within a millimetre, with just one hand. And when the wearer wants to release turn-lock fastener 1 to open the helmet straps, then rotating knob 7 is rotated in the loosening direction whereupon rotating knob 7 initially rotates alone in line with the idle movement and freely rotatably relative to intermediary wheel 33 until its drive pin 40 reaches the opposite idle movement end position at limit end 41*b* in recess 41. In this idle movement end position, the slopingly inclined control surface 34*a* has simultaneously moved over the surface facing it, i.e. the surface of the top projecting tooth 30*b* of control pawl 30, thereby causing—against the spring preloading—the bottom projecting tooth 30*a* of locking pawl 30 to be disengaged from the teeth 29 of annular gear 28. In this manner, locking pawl 30 has been brought into its releasing position, where it is held for as long as rotating knob 7 is rotated in the direction of the loosening movement, or drive pin 40 of this rotating knob 7 is retained in the idle movement end position. Unlocked in this way, the locking pawl device allows easy actuation of the Geneva mechanism in such a manner that cord wheel 13 can be rotated, thereby unwinding pull cords 8 from this cord wheel 13. The pull cords can be contrived on each side of the turn-lock fastener as loops, so that one loop end is fixed to the turn-lock fastener and the other is wound around the cord wheel. The loop is then guided round a loose roller which sits at the end of a strap. The helmet straps can be tightened or loosened by winding up or unwinding the free loop end.

FIG. 5 shows how turn-lock fastener 1 is incorporated, and how it functions, in a plastic chin shell 5 of a helmet which cups the chin. On both sides of turn-lock fastener 1 this shell 5 has recesses 9 in the form of slits 9 running radially from turn-lock fastener knob 7 in the direction of the straps 3 converging from the sides, said slits being a few centimetres long. Displaceably mounted in each slit 9 there is a slide 10, on which the two straps 3 converge from each side of the helmet and to which they are secured. Slide 10 itself is contrived such that it forms a loose roller for loop 8 running around it. Each slide 10 therefore acts like a deflecting roller, and together with loop 8, forms a block and tackle. The inside of plastic shell 5 is lined with a foam insert which can be glued to plastic shell 5, or detachably attached to it, e.g. by means of press-buttons or Velcro fasteners. When loops 8 of turn-lock fastener 1 are fully extended on the left and right of rotating knob 7, slides 10 can be pulled to their outermost position and the strap is then sufficiently loosened for the wearer to pass his head through the strap from below, thereby allowing the helmet to be slipped on over the wearer's head. After putting on the helmet, the moulded chin part 5 is pushed over the chin and then the rotating knob 7 of turn-lock fastener 1 is turned with one hand, which can even be done when wearing an ice-hockey glove, whereupon loops 8 are pulled together and chin element 5 is pulled flush against the chin to suit the wearer. Hence the helmet can be put on and tightened as required by the wearer himself. The four straps 3 are adjusted once to their optimum length and secured by means of the press-buttons 4 shown in FIG. 1, after which the strap basically remains taut all the time.

FIG. 6 shows a simplified construction of a turn-lock fastener 1 which has fewer parts than the turn-lock fastener shown in FIGS. 2 to 4, but functions in a similar way. In FIG. 6, the turn-lock fastener is shown assembled in a cross-section seen from the side, whilst FIG. 7 shows the turn-lock fastener from above, without the gripping wheel. As can be seen, this turn-lock fastener 1 essentially comprises a base 42, a dial 43 with a coaxial gearwheel 47 underneath, a top cover formed by a gripping wheel 52, and a bottom cover 58. This turn-lock fastener allows plastic straps 44, which are shown here seen from the side, to be tightened instead of cords, as will be explained with reference to the following description.

From FIG. 7 it can be seen that base 42 of this turn-lock fastener 1 has a circular bore whose inside edge 50 is provided with toothing. This bore is intended to accommodate a dial 43, and is indeed precisely adapted in diameter and depth to accommodate dial 43. On top of dial 43 there is a recess 59 in which a spring-loaded pawl 49 is inserted. Recess 59 coincides with the shape of pawl 49 so that the pawl can be displaced in a radial direction relative to dial 43. Pawl 49 is pressed radially outwards by a spring 48 inside recess 59, whereupon the front pawl edge 51 engages in the stationary toothing 50 on the inside edge of the bore in base 42. Pawl 49, which can be rotated around the centre of the tensioning device, and stationary toothing 50 each have, on one side, a slope with a slight incline so that when dial 43 is turned clockwise as in FIG. 7, the slope of pawl 49 slides over the slightly inclined sloping surfaces of toothing 50 and pawl edge 51 re-engages behind each tooth due to the force of spring 48, where it prevents dial 43 from being turned in the opposite direction. The top element of tensioning device 1 forms a gripping wheel 52. This gripping wheel 52 can be turned in the opposite direction to dial 43. A bolt 53, which is rigidly connected to gripping wheel 52, and which runs inside dial 43 parallel to dial axis 54, passes through pawl 49 in a recess 55. Recess 55 in pawl 49 has a sloping surface 56, along which bolt 53 slides when gripping wheel 52 is turned anticlockwise, thereby pulling pawl 49 out of toothing 50. The underneath of base 42 is covered by a cover 58.

FIG. 8 shows the turn-lock fastener 1 of FIGS. 6 and 7 from below, without bottom cover 58. One can see from this Figure how straps 44 can be pulled together by means of the rack-and-pinion drive that is formed. The two straps 44, which run in opposite directions, are positioned at a distance from each other and adjacent to each other in base 42. The facing longitudinal edges of the end portions 45 of straps 44 have a toothing 46. Gearwheel 47, which is concentrically and rigidly secured to the underside of dial 43, engages with both toothings 46 so that when gearwheel 47 is turned, both ends of straps 44 are either pulled towards each other or pushed away from each other. Naturally, a turn-lock fastener that functions in line with this principle can also be made to operate with just one strap 44. In this case, the turn-lock fastener itself is mounted on a rigid part towards which a single strap can be drawn for the purpose of tightening, and released in response to movement in the opposite direction.

One strap 44 or two straps 44 can be tightened or released using a turn-lock fastener 1 of this type by rotating gripping wheel 52. When rotated clockwise, strap 44 or straps 44 are pulled into turn-lock fastener 1, thereby tightening them. When rotated anticlockwise, strap 44 or straps 44 are moved in the opposite direction, thereby loosening them. Once tightened, pawl 49 stops strap(s) 44 from working loose by themselves. When gripping wheel 52 is rotated, bolt 53, which is rigidly connected to gripping wheel 52, moves with it. If gripping wheel 52 is rotated clockwise, bolt 53 abuts against the radial surface 57 of recess 55 in pawl 49 and acts as a driver for pawl 49. As a result, pawl 49, which is connected to dial 43, is also rotated clockwise and the spring-loaded pawl 49, which engages in the toothing 50 of the inside edge of base 42, slides with its pawl edge 51 along the slightly inclined slope of one tooth of stationary toothing 50 and is pressed radially inwards against the force of spring 48. Once the end of a tooth is reached, pawl edge 51 re-engages behind a tooth due to the force of spring 48 and prevents dial 43 from being moved in the opposite direction. Gearwheel 47, which is connected to dial 43, executes the same rotating movement as dial 43 and pulls straps 44, whose toothed edges 46 engage in gearwheel 47, together. Gearwheel 47 acts on edges 46 of straps 44 like a rack-and-pinion drive, where rotating gearwheel 47 causes a linear displacement of straps 44.

To loosen the strap(s) 44, gripping wheel 52 is rotated anticlockwise. Dial 43 remains initially blocked, however, because the pawl edge 51 of pawl 49 is in the process of engaging with toothing 50 on the inside of base 42, or is already engaged. When gripping wheel 52 is rotated further, bolt 53, which is rigidly connected to it, turns with it and then slides in recess 55 of pawl 49 along sloping surface 56. As it does so, it pulls pawl 49 radially inwards, resp. back out of toothing 50. As soon as pawl 49 disengages from toothing 50, dial 43 rotates and with it gearwheel 47 with gripping wheel 52. Gearwheel 47 pushes straps 44 out of turn-lock fastener 1, thereby loosening them.

FIG. 9 shows another alternative turn-lock fastener, in this instance on a construction workers helmet 63 with shade 73 seen from the rear in a top plan view. In the example shown, plastic straps 64 lead from both sides to turn-lock fastener 1. Turn-lock fastener 1 could also function with just one strap 64, which would run towards turn-lock fastener 1 from one side. The turn-lock fastener 1 shown here basically enables the straps to be tightened in two phases. To start with, the straps are adjusted approximately, or tightened approximately, in single, separate stages. For this purpose one strap or both straps 64 can be in two parts, with both parts overlapping. One strap part has a row of holes 65 on which a slit-cross 71 is superposed, whilst the strap part underneath has burls 66 that fit into these holes 65. Thanks to slit-cross 71, which allow holes 65 to enlarge, these burls 66 can be pressed into these holes 65 located opposite on the overlapping strap parts. The ends of burls 66 are slightly thickened so that they cannot slip out of holes 65 by themselves. This approximate tensioning is not sufficient, however, to tighten strap 64 continuously so that it fits snugly, and not too loosely, on the wearer's head. With the turn-lock fastener shown here, the continuous adjustment is effected by means of a special dial 62. Dial 62 is rotatably disposed on a base 74 underneath it. In the example shown here, the straps 64 for continuous tightening lead from two sides underneath dial 62 into turn-lock fastener 1 and are guided in base 74 along a guide channel in the longitudinal direction. Dial 62 has two curved grooves 67,68. These grooves 67,68 can break through dial 62 completely, as shown, or can simply be contrived in the bottom of the dial material so that they are not visible from the outside. At each end of straps 64 there is a vertically projecting cam 69,70. Cam 69 of one strap 64 projects into groove 67, whilst cam 70 on the other strap 64 projects into the other groove 68. Dial 62 can either be mounted via a central axis on base 74 underneath, or be rotatably attached to such a base by its edges in segment-shaped mountings. In both cases, these two parts can be made as injection-moulded plastic parts in such a way that for the purpose of assembly, they merely have to be pressed together, whereupon the axis in dial 62 engages in a corresponding hole in the base, or the edge of dial 62 clicks into the lateral guides on the base. If dial 62 in this Figure is turned clockwise, the outer edges of the semi-circularly curved grooves 67,68 act like cam discs along which burls 69,70 slide, with—on account of the ever decreasing distance to the centre of dial 62—these burls being pressed inwards towards this centre. In the end position, when dial 62 is rotated by 180°, cams 69,70 will have reached the ends of curved grooves 67,68.

The whole procedure for continuously tightening this turn-lock fastener, and hence the straps leading up to it, is shown in FIG. 10, which shows the sequence of movements through a series of frames. Each frame indicates the degrees through which the dial has already been rotated. With the semi-circularly curved grooves used here, which have a constant radius of curvature, when the dial is rotated it imparts movement to the straps attached to the cams that is not proportional to the rotation of the dial. Each frame indicates the movement already imparted. One can see that in the beginning and end zones of the groove, less movement is imparted than in the middle zone. If one rotates the dial back anticlockwise from the end position shown at the bottom of the Figure, this time the cams are pressed outwards away from the insides of the semi-circularly curved grooves, whereupon the straps are pushed apart and thereby loosened.

To maintain the movement proportional to the rotation throughout the rotation of the dial from 0° to 180°, the curve of the groove would have to be such that the radius of curvature changes along the curve, as shown in FIG. 11. Here it can be seen that, starting from rotation position 0° and in comparison with a constant radius, this radius of curvature initially grows bigger very quickly, then remains approximately constant over a certain portion, after which it becomes gradually smaller than the constant radius to end up, in around the 180° position, with the same dimensions as the constant radius. The curve described by the groove in this case is an Archimedean spiral.

To ensure that the straps are held securely in any position of the dial between 0° and 180°, the dial can be fitted with a brake. In the simplest case a rubber O-ring is inserted along the outer edge of dial 62 between it and straps 64 underneath, which generates sufficient friction between these two parts to overcome the acting tightening force. For this purpose there can be a special circular groove, in which the O-ring is inserted, in the bottom edge of dial 62.

FIG. 12 shows another embodiment of a helmet with one of the turn-lock fasteners described above. This helmet is a baseball helmet 80, with a special, completely different shape, shown here from the side. This helmet 80 is secured on the wearer's head by means of a strap 81 at the back of the helmet so that the strap holds helmet 80 securely in the nape of the wearer's neck. This helmet 80 is also made from a plastic shell and has a foam cushion uppermost on the inside, with which helmet 80 rests against the wearer's head. Another foam insert 82 extends as shown by the dashed lines around the nape of the wearers neck. At the back this insert is left open to a certain degree by a cut-out section in the plastic shell of the helmet. Strap 81 extends parallel to, and somewhat below, the circumference of the wearer's head, around the nape of the wearer's neck, from one ear protection cap to the other. A turn-lock fastener 1 is incorporated into this strap 81. Associated with the latter there is a plastic strap with longitudinal slits in each of which a slide 10 is guided, to which the two ends of the rigid strap sections are attached. The loops of turn-lock fastener 1 are guided around the two slides 10 so that each slide 10 forms a block and tackle for the ends of the strap sections. When strap 81 is tightened by turning rotating knob 7, strap 81 is pulled together and presses foam element 82 against the nape of the wearer's neck. The counter-pressure comes from the front side of the helmet and acts on the wearer's forehead. Rotating knob 7 is turned until helmet 80 is held sufficiently snugly against the wearer's head, but is not so tight that it is uncomfortable. Helmets for e.g. construction workers and miners could be made to a similar design. In contrast to a baseball helmet, however, these latter leave the ears free and are less, or not at all, padded with foam inserts.

FIG. 13 shows a baseball helmet 80 seen from the rear. One recognizes strap 81 with the two fixed strap sections and the plastic shell 83 belonging to the turn-lock fastener, in which both slides 10 are guided, around which run the loops 8 of turn-lock fastener 1. Underneath strap 81 one can see foam insert 82, which, in this example, is attached to the inside of the helmet by means of rivets.

FIG. 14 shows an alternative embodiment of a baseball helmet 80, seen from the rear. Here, turn-lock fastener 1 is incorporated in the plastic shell of helmet 80 and strap 84 runs horizontally between the recess in the rear part of the plastic shell. The strap is tightened by means of cords 85,86, which run outwards from both sides of turn-lock fastener 1 to deflecting rollers 87, and from there back to the two ends of strap 84. Between turn-lock fastener 1 and deflecting rollers 87, the cord is guided in a guide channel that runs along the inside of the helmet. Both strap 84, turn-lock fastener 1 and its cords 85,86 can be covered over on the inside of the helmet with a section of foam so that no pressure points are created on the wearers head.

FIG. 15 shows a cyclist's helmet in a section along its longitudinal axis, seen from the side. The front of the helmet is on the left side of the page and the rear is on the right. The helmet is made from a solid material 90 in which a turn-lock fastener 1 is incorporated as shown here at the rear of the helmet, said turn-lock fastener being mounted on a conical insert element 97 which fits inside a cut-out-section in helmet material 90. On the inside of the helmet there is a T-shaped tongue 91, with the T being upside down. This tongue 91 is attached to the inside of the helmet at point 92. Its T-bar forms the actual strap that runs round the nape of the wearer's neck. In the section shown here, however, only one part 93 of this T-bar is visible. Along this T-bar resp. along the strap runs pull cord 8 which forms a loop that runs round a deflecting roller 94 which is contrived in the helmet material from the inside of the helmet. This deflecting roller can be rotatably mounted, or it can simply be a fixed plastic cam with a circumferential groove in which the loop of pull cord 8 is threaded. The end of one cord is rigidly attached to the T-bar part 93 of tongue 91, whilst the other end of the cord leads to turn-lock fastener 1, where it can be drawn into turn-lock fastener 1 as already described several times and adjusted, and therefore tightened, progressively or continuously. Conversely, it can also be released from turn-lock fastener by turning rotating knob 7 in the opposite direction, thereby releasing the tension. Rotating knob 7 has special wing ribs 95 so that it can easily be rotated even with gloves, despite the way it is incorporated in the helmet. To put on this cyclist's helmet the wearer merely has to slip it over his head and turn rotating knob 7 to tighten the strap formed by T-bar 93 of suspended tongue 91. This causes the strap to fit snugly round the nape of the wearer's neck, whilst the front inside of the helmet is tightened against the wearer's forehead, which creates the counter-pressure that ensures the helmet stays securely on the wearer's head. The wearer can dose the tension very finely, and adjust it with one hand, even when cycling.

FIG. 16 shows another embodiment of a cyclist's helmet. This helmet is essentially the same as the one described above, with the exception that it has no suspended tongue. In this instance, strap 96 is held by pull cord 8 itself. For this purpose it has two small flexible guide tubes which run along strap 96 and are rigidly connected to it, or it is made directly from a profile strap that includes guide tubes of this type, through which cord 8 is then pulled. Viewing the helmet from the rear, the cord preferably first runs out of turn-lock fastener 1 counter to the tightening direction and then into strap 96 at the bottom, or into the tube on strap 96, and runs close to the bottom edge of strap 96 to the end of the strap. From there cord 8 runs round deflecting roller 94 on this side of the helmet. It then leads back to the strap and runs inside the strap, or the associated guide tubes, along and close to the top edge, to the other end of the strap, from where it runs round the deflecting roller on the other side of the helmet and, finally, back through a guide tube along the bottom edge of the strap to turn-lock fastener 1.

FIG. 17 shows the cyclist's helmet of FIG. 16 in another view from below. One can recognize strap 96 and turn-lock fastener 1 disposed beneath it in the rear part of helm material 90. The cord loops 8 run on both inner sides of the helmet round deflecting points disposed there. This cyclist's helmet is therefore compact and the strap is attractively integrated inside the helmet without hanging down in an unsightly fashion.

It is obvious, of course, that many different types of helmet can be fitted with the basic system allowing the strap to be directly or indirectly adjusted by means of such a turn-lock fastener 1 and then fixed in each position. Equally, embodiments where a corresponding strap with turn-lock fastener 1 is fitted under the chin are also possible. Turn-lock fastener 1 can also be mounted in some other position on the helmet, e.g. at the front, or to the side. Its cords are then guided around the helmet shell in such a manner that they can tighten the strap as required wherever it runs.

What is claimed is:

1. A helmet with an adjustable strap, comprising, said helmet having said strap, the length of said strap used for securing said helmet on a user's head being continuously adjustable, or in steps of 1.5 mm, at the most, and fixed or released in any position via a turn-lock fastener operable with one hand, wherein said strap is a strap running along an inside of said helmet, with a tensioning of said strap being able to be increased and decreased for tightening and loosening, respectively, said helmet on the user's head by said turn-lock fastener, which is rigidly incorporated in material comprising said helmet, and wherein cords of said turn-lock fastener are guided from its two opposite sides along an inner side of said helmet to deflecting rollers, or deflecting points, on said material comprising said helmet, and being further guided therefrom along said strap to be tightened.

2. The helmet with adjustable strap of claim 1, designed as a cyclist's helmet, wherein said strap is a strap which forms a T-bar of a T-shaped tongue, which is secured upside down on the inside of the helmet with a bottom end of the T-bar, with said cords of said turn-lock fastener being guided along said strap.

3. The helmet with adjustable strap of claim 1, designed as a baseball helmet, wherein said strap runs horizontally between a recess in a rear part of a plastic shell material of the helmet, and from each of its ends a cord is guided which runs along a guide channel provided inside the helmet, via deflecting rollers to said turn-lock fastener incorporated in, material comprising said helmet, said cords being capable of being tensioned, and thereby tightened for securing said helmet on the user's head.

4. The helmet with adjustable strap of one of claim 1, wherein said turn-lock fastener has a base with a rotatable dial on top, as well as at least two additional straps leading to it, which has a toothing on one of its longitudinal edges and is threaded into said base, so that on the underneath of said rotatable dial there is a concentric gearwheel which engages in said toothing on said strap, so that when said rotatable dial is turned in one direction it causes said additional straps to be pulled together, and when turned in the opposite direction it loosens said additional straps, and in that there are means for fixing and releasing said rotatable dial in different positions on said base.

5. The helmet with adjustable strap of claim 4, wherein said, at least, two additional straps running in opposite directions are guided in said base at a distance from, and adjacent to each other, and in that two facing edges of an end portion of said, at least, two additional straps are provided with said toothing, with the concentric gearwheel engaging in both sets of teeth at the same time.

6. The helmet with adjustable strap of claim 4, wherein said means for fixing said rotatable dial in different positions comprises a pawl movable inside said rotatable dial, which is radially outwardly loaded by a spring, as a result of which it engages in a stationary toothing provided along the inside edge of said base.

7. The helmet with adjustable strap of claim 6, wherein said pawl and said toothing each have one side that is sloped so that when said rotatable dial is rotated in the direction for tightening said, at least, two additional straps, the sloping surface of said pawl slides over gently inclined surfaces of said toothing and an edge of said pawl re-engages behind each tooth due to the force of a spring, where it blocks any movement of said rotatable dial in an opposite direction.

8. The helmet with adjustable strap of claim 6, wherein said rotatable dial has a gripping wheel rotatable in an opposite direction to said rotatable dial, which is connected to a bolt running inside said rotatable dial and parallel to an axis of said rotatable dial and passes through said pawl in a recess, with the recess having a sloping surface along which said bolt slides when said gripping wheel is turned, thereby, as said gripping wheel is rotated in the direction for loosening said, at least, two additional straps are drawing said pawl back out of said toothing, whereupon said rotatable dial is rotatable in the loosening direction.

9. The helmet with adjustable strap of claim 1, wherein said strap is attached to said turn-lock fastener via a cam guidable in the tightening direction of said strap and engages in a curved groove contrived in an underneath dial which is rotatably mounted on a base via a central axis, so that when said dial is rotated, an edge of the curved groove acts as a cam disc and therefore displaces said cams in or against the direction for tightening said strap, depending on the direction of rotation.

10. The helmet with adjustable strap of claim 9, wherein said underneath dial includes two semi-circularly curved grooves arranged so that, taken together, they represent an "S" which is interrupted in its middle, and in that end positions of said cams guided in said grooves lie along the same line.

11. The helmet with adjustable strap of claim 9, wherein the curve of said groove forms an Archimedean spiral so that when said underneath dial is rotated, the edges of the groove impart motion in, or against, the direction of tightening and proportional to the angle of rotation, to said cams guided in the groove.

12. The helmet with adjustable strap of claim 1, wherein said turn-lock fastener has a cord wheels the top of which forms a Geneva cross with radial guide grooves disposed around its periphery, and a drive wheel with two eccentrically disposed drive pins, which engage in the radial guide grooves on the Geneva cross, thereby forming a Geneva mechanism, as well as a top cover, which is provided with a locking pawl for blocking said turn-lock fastener in different tightened positions.

13. A helmet with an adjustable strap, comprising, said helmet having said strap, the length of said strap used for securing said helmet on a user's head being continuously adjustable, or in steps of 1.5 mm, at the most, and fixed or released in any position via a turn-lock fastener operable with one hand, wherein said strap is a strap running along an inside of said helmet, with a tensioning of said strap being able to be increased and decreased for tightening and loosening, respectively, said helmet on the user's head by said turn-lock fastener, which is rigidly incorporated in material comprising said helmet, wherein said strap is a strap which forms a T-bar of a T-shaped tongue, which is secured upside down on the inside of the helmet with a bottom end of the T-bar, with cords of said turn-lock fastener being guided along said strap.

14. A helmet with an adjustable strap, comprising, said helmet having said strap, the length of said strap used for securing said helmet on a user's head being continuously adjustable, or in steps of 1.5 mm, at the most, and fixed or released in any position via a turn-lock fastener operable with one hand, wherein said strap is a strap running along an inside of said helmet, with a tensioning of said strap being able to be increased and decreased for tightening and loosening, respectively, said helmet on the user's head by said turn-lock fastener, which is rigidly incorporated in material comprising said helmet, wherein said strap is attached to said turn-lock fastener via a cam which is guidable in the tightening direction of said strap and engages in a curved groove contrived in an underneath dial which is rotatably mounted on a base via a central axis, so that when said dial is rotated, an edge of the curved groove acts as a cam disc and therefore displaces said cams in or against the direction for tightening said strap, depending on the direction of rotation.

15. The helmet with adjustable strap of claim 14, wherein said underneath dial includes two semi-circularly curved grooves arranged so that, taken together, they represent an "S" which is interrupted in its middle, and in that end positions of said cams guided in said grooves lie along the same line.

16. The helmet with adjustable strap of claim 14, wherein the curve of said groove forms an Archimedean spiral so that when said underneath dial is rotated, the edges of the groove impart motion in, or against, the direction of tightening and proportional to the angle of rotation, to said cams guided in the groove.

17. A helmet with an adjustable strap, comprising, said helmet having said strap, the length of said strap used for securing said helmet on a user's head being continuously adjustable, or in steps of 1.5 mm, at the most, and fixed or released in any position via a turn-lock fastener operable with one hand, wherein said strap is a strap running along an inside of said helmet, with a tensioning of said strap being able to be increased and decreased for tightening and loosening, respectively, said helmet on the user's head by said turn-lock fastener, which is rigidly incorporated in material comprising said helmet, wherein said turn-lock fastener has a cord wheel, the top of which forms a Geneva cross with radial guide grooves disposed around its periphery, and a drive wheel with two eccentrically disposed drive pins, which engage in the radial guide grooves on the Geneva cross, thereby forming a Geneva mechanism, as well as a top cover, which is provided with a locking pawl for blocking said turn-lock fastener in different tightened positions.

* * * * *